US006860178B2

(12) United States Patent
Wang

(10) Patent No.: US 6,860,178 B2
(45) Date of Patent: Mar. 1, 2005

(54) EXTENSION APPARATUS BETWEEN TOOL AND TOOL BIT

(76) Inventor: Mei-Chen Wang, No. 141, Lane Miu Tan, Shao An Li, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 10/421,291

(22) Filed: Apr. 23, 2003

(65) Prior Publication Data

US 2004/0211300 A1 Oct. 28, 2004

(51) Int. Cl.[7] ..... B25B 23/16
(52) U.S. Cl. ..... 81/177.2; 81/451; 81/125; 7/138
(58) Field of Search ..... 81/451, 125, 438, 81/177.2; 7/138, 165

(56) References Cited

U.S. PATENT DOCUMENTS 5,878,637 A * 3/1999 Liu ..... 81/451
6,148,699 A * 11/2000 Han ..... 81/451
6,520,509 B1 * 2/2003 Vasudeva et al. ..... 81/438
6,644,150 B2 * 11/2003 Chen ..... 81/438

* cited by examiner

*Primary Examiner*—Debra S. Meislin
(74) *Attorney, Agent, or Firm*—Alan D. Kamrath; Nikolai & Mersereau, P.A.

(57) ABSTRACT

An extension apparatus is provided for connecting a tool with a tool bit. The extension apparatus includes a driving element with a first end for engagement with the tool and a second end for engagement with the tool bit, a telescopic element inserted in the driving element, a magnet attached to the telescopic element and a barrel movably mounted on the driving element for receiving a fastener to be driven via the tool bit.

20 Claims, 10 Drawing Sheets

EXTENSION APPARATUS BETWEEN TOOL AND TOOL BIT

FIELD OF INVENTION

The present invention relates to a tool and a tool bit and, more particularly, to an extension apparatus connecting a tool with a tool bit.

BACKGROUND OF INVENTION

U.S. Pat. No. 5,878,637 discloses a magnetic driving tool having a telescopic pipe. The driving tool includes a handle 20, a barrel 10 and a telescopic pipe 30. The handle 20 defines a hole 22 and four grooves 24 communicated with the hole 22. The barrel 10 includes an end 14 for receiving a tool bit 90 and an opposite end 18 for insertion in the hole 22. The barrel 10 includes four keys 16 formed thereon. The keys 16 are inserted in the grooves 24. The telescopic pipe 30 is inserted in the barrel 10, with an end 32 inserted in the hole 20. A magnet 34 is attached to an opposite end of the telescopic pipe 30. The telescopic pipe 30 can be extended beyond the barrel 10 so that the magnet 34 can be used to restore a missing bolt by means of magnetic attraction. The magnet 34 is useful restoring a missing bolt; however it is useless in maintaining a bolt.

The present invention is therefore intended to obviate or at least alleviate the problem encountered in the prior art.

SUMMARY OF INVENTION

It is the primary objective of the present invention to provide a tool with an extension apparatus that can encompass a fastener to be driven by means of the tool.

According to the present invention, an extension apparatus is provided for connecting a tool with a tool bit. The extension apparatus includes a driving element with a first end for engagement with the tool and a second end for engagement with the tool bit, a telescopic element inserted in the driving element, a magnet attached to the telescopic element and a barrel movably mounted on the driving element for receiving a fastener to be driven via the tool bit.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the drawings.

DETAILED DESCRIPTION OF EMBODIMENTS

Figure 1:
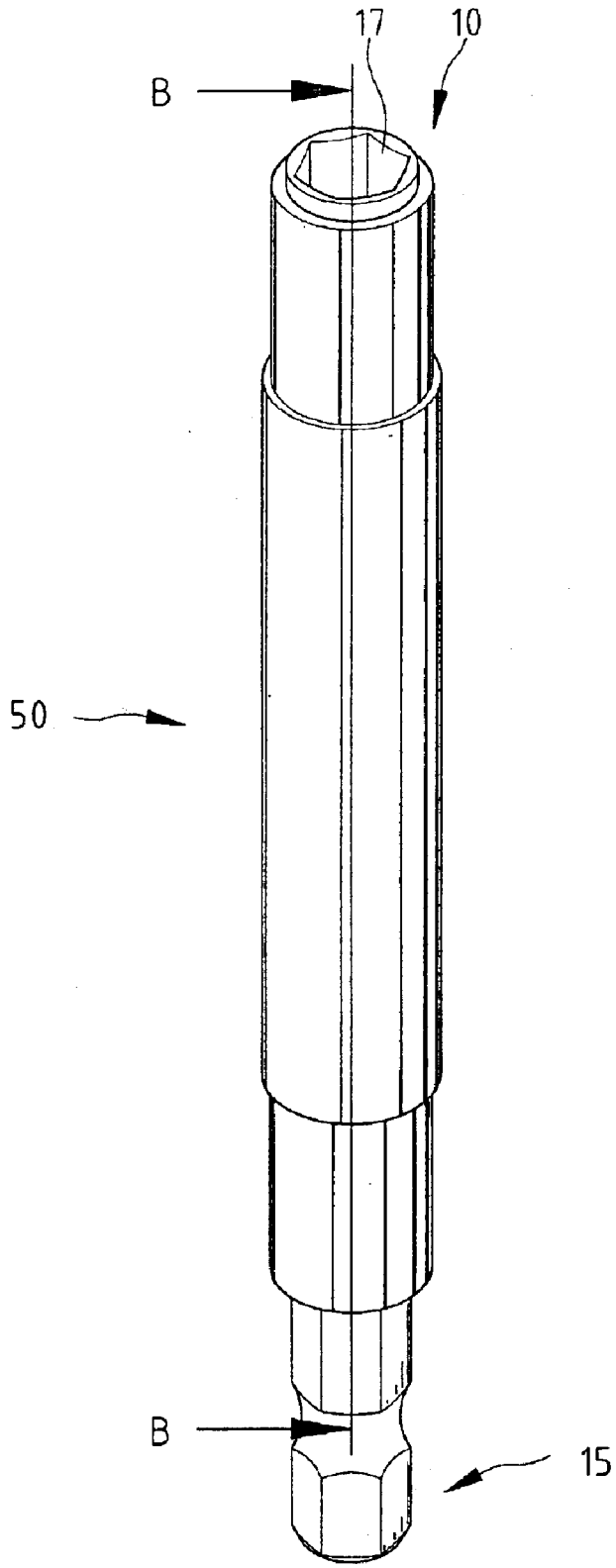
FIG. 1 is a perspective view of an extension apparatus for connecting a tool with a tool bit according to a first embodiment of the present invention, showing the extension apparatus to include a driving element, a telescopic element inserted in the driving element, a magnet attached to the telescopic element and a barrel mounted on the driving element.
Figure 2:
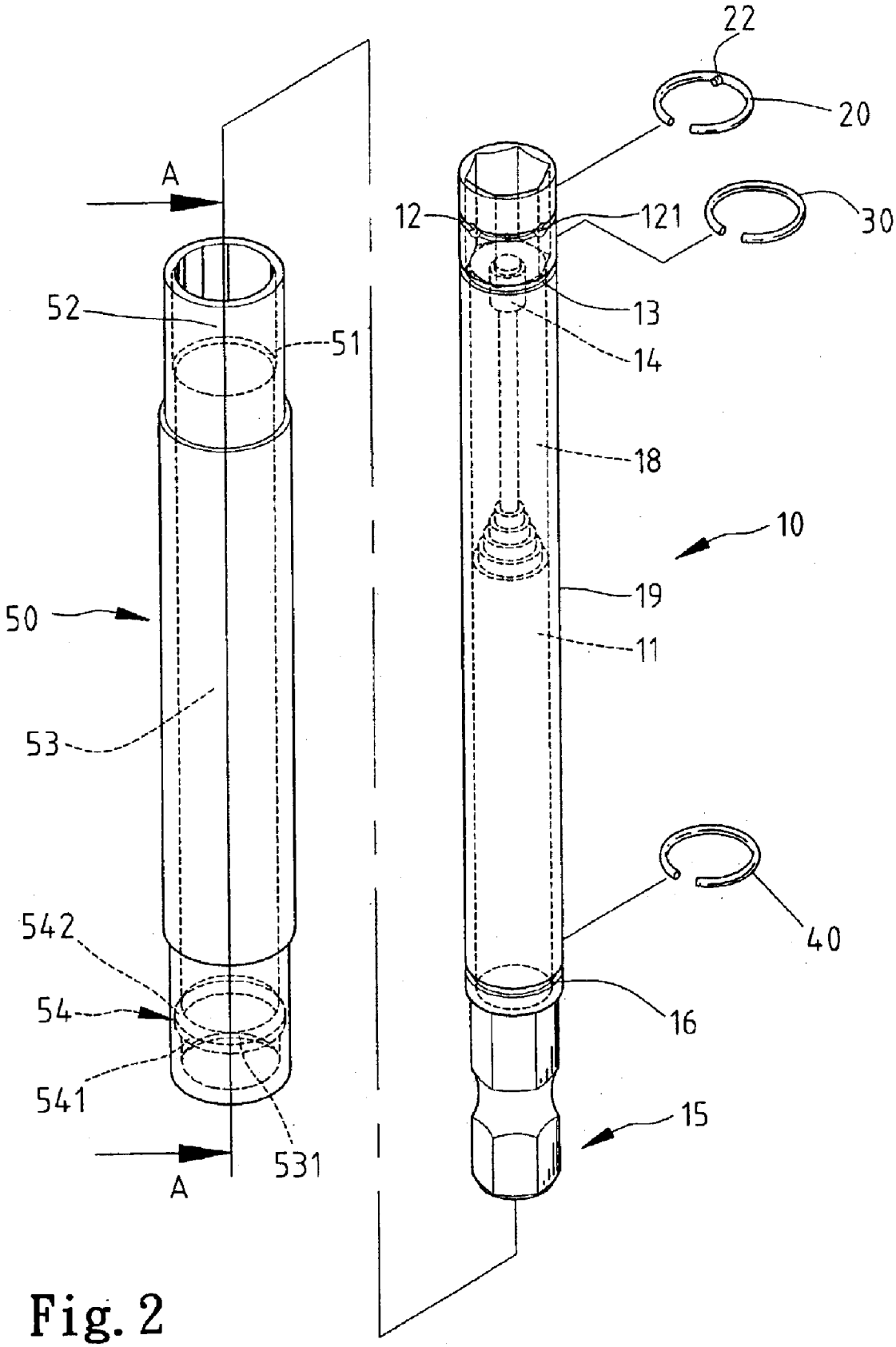
FIG. 2 is an exploded view of the extension apparatus of FIG. 1.

Referring to FIGS. 1~9, according to a first embodiment of the present invention, an extension apparatus for connecting a tool (not shown) with a tool bit 60 is shown.

The extension apparatus includes a driving element 10, a telescopic element 11 inserted in the driving element 10, a magnet 14 attached to the telescopic element 11 and a barrel 50 movably mounted on the driving element 10.

The driving element 10 includes an insert 15 for insertion in the tool and a socket 19 integrated with the insert 15 for receiving the tool bit 60.

The socket 19 includes an internal side and an external side. In the external side of the socket 19, a first annular groove 12, a second annular groove 13 and a third annular groove 16 are defined. An aperture 121 extends from the internal side to the external side of the driving element 10. The aperture 121 is communicated with the first annular groove 12. The driving element 10 defines a hexangular space 17 for receiving a tool bit 60 and a circular space 18 for receiving the telescopic element 11.

A first ring 20 is put in the first annular groove 12. The first ring 20 includes a boss 22 formed thereon. The boss 22 is inserted into the hexangular space 17 through the aperture 121. The first ring 20 may be a C-ring or O-ring.

A second ring 30 is put in the second annular groove 13. The second ring 30 may be a C-ring or O-ring.

A third ring 40 is put in the third annular groove 16. The third ring 40 may be a C-ring or O-ring.

Figure 3:
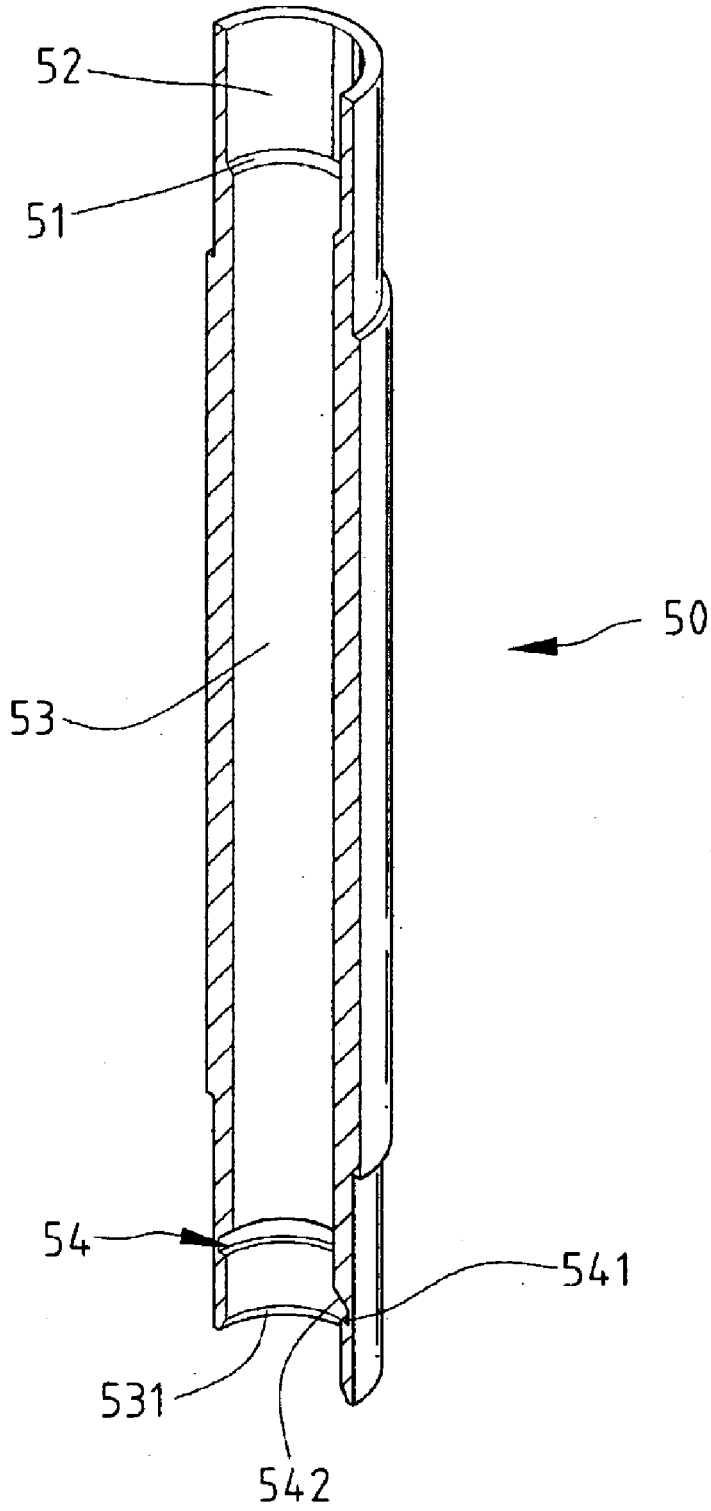
FIG. 3 is a cross-sectional view of the barrel of FIG. 1.

As best shown in FIG. 3, the barrel 50 includes an internal side and an external side. The barrel 50 defines a first space 52 and a second space 53 of a reduced diameter relative to the first space 52, thus forming an annular slope 51 on the internal side between the first space 52 and the second space 53. The annular slope 51 facilitates upward sliding over the second ring 30 and the first ring 20. An annular groove 54 extends in the internal side of the barrel 50 and defines an annular shoulder 541 and an annular slope 542. An annular slope 531 is formed on the internal side of the barrel 50. The annular slope 531 facilitates sliding of the barrel 50 onto the socket 19. The annular slope 542 facilitates further sliding of the barrel 50 beyond the first ring 20 and the second ring 30.

Figure 4:
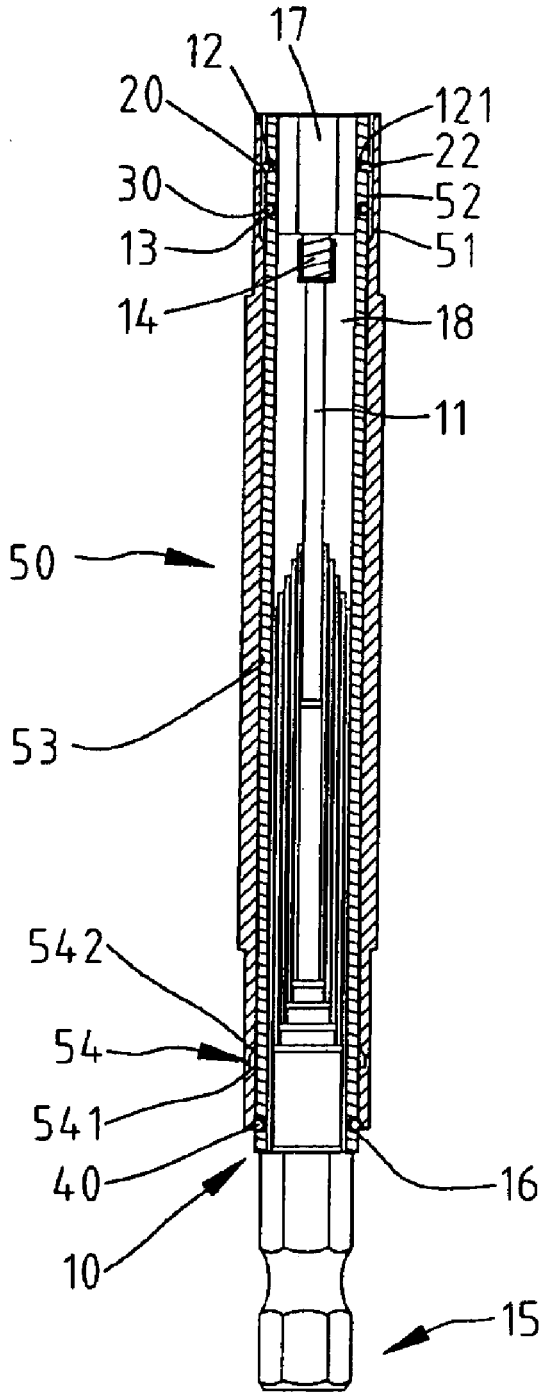
FIG. 4 is a cross-sectional view of the extension apparatus of FIG. 1.

Referring to FIG. 4, the barrel 50 and the driving element 10 are in a non-extended position. The first space 52 allows the first ring 20 and the second ring 30 to expand.

Figure 5:
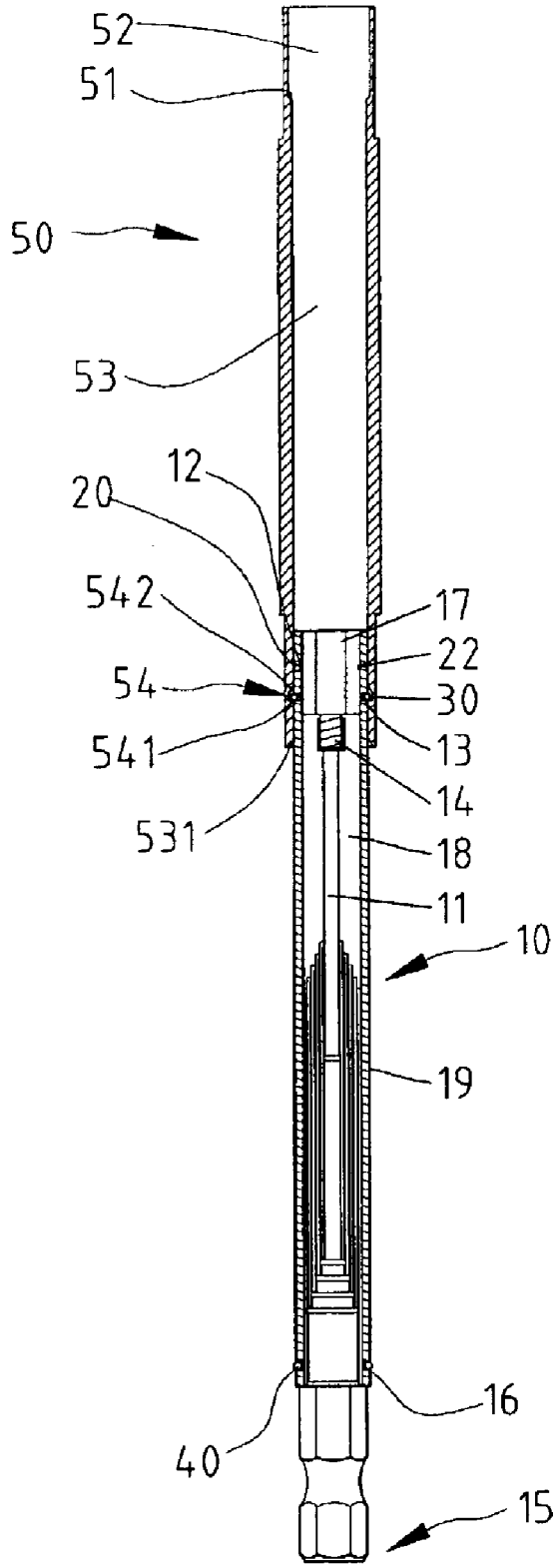
FIG. 5 is similar to FIG. 4 but showing the barrel and the driving element in an extended position.

Referring to FIG. 5, the barrel 50 and the driving element 10 are in a fully extended position. The annular shoulder 541 abuts the second ring 30, thus keeping the barrel 50 on the socket 19.

Figure 6:
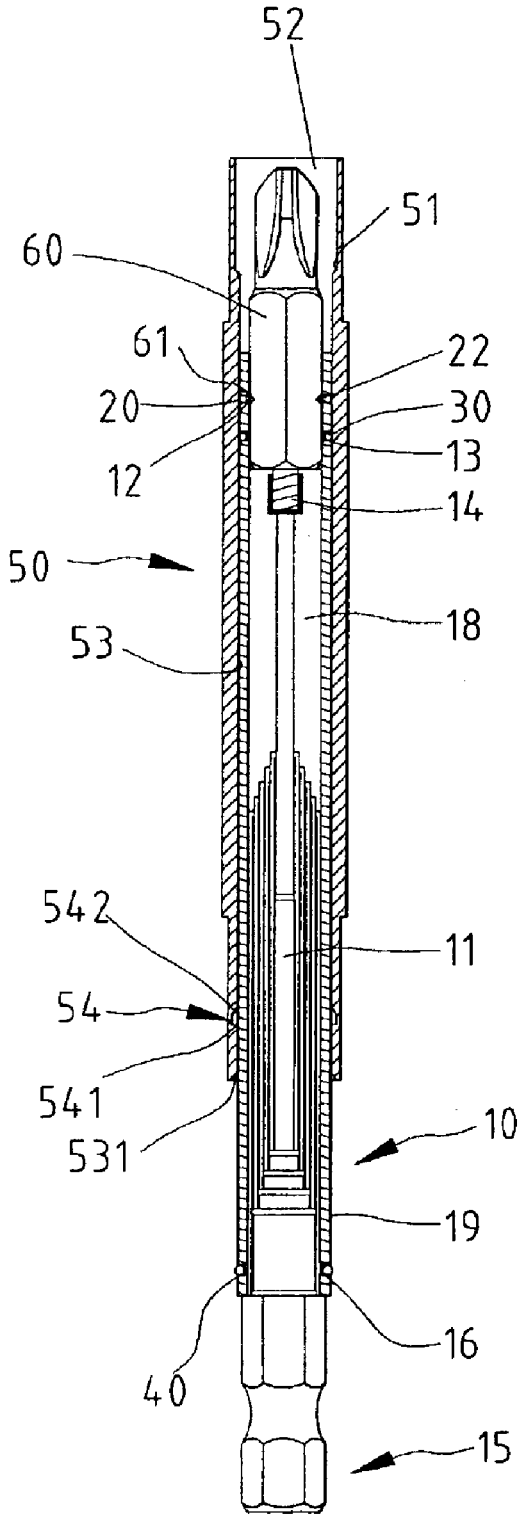
FIG. 6 is similar to FIG. 4 but showing a tool bit put in the barrel.

Referring to FIG. 6, the barrel 50 and the driving element 10 are in a position between the non-extended position and the fully extended position. The tool bit 60 is inserted in the hexangular space 17 of the socket 19. The internal side of the barrel 50 pushes the first ring 20 inwards. Thus, the boss 22 contacts a retention groove 61 of the tool bit 60, thus retaining the tool bit 60 in the hexangular space 17 of the socket 19.

Although not shown, in an alternative embodiment, the first ring 20 may be an annular clip for clipping the socket 19, thus inherently inserting the boss 22 into the hexangular space 17 of the socket 19.

Figure 7:
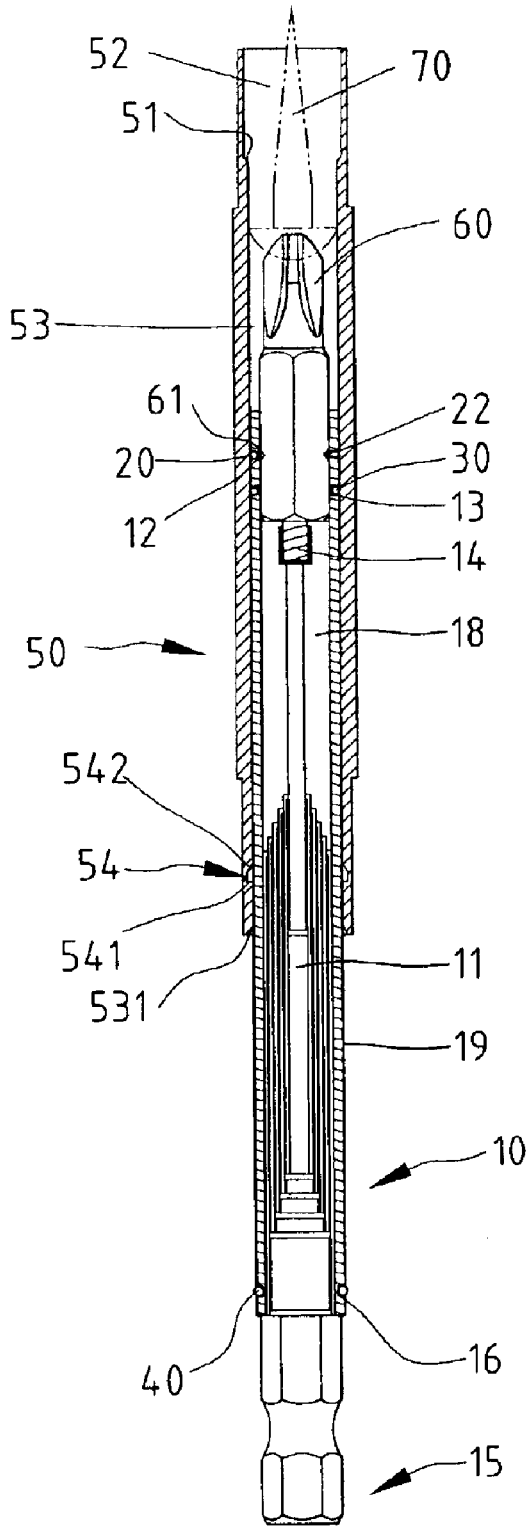
FIG. 7 is similar to FIG. 6 but showing a screw engaged with the tool bit put in the barrel.

Referring to FIG. 7, the barrel 50 is moved from the position shown in FIG. 6 for a distance. Thus, a portion of the barrel 50 extends beyond the socket 19 in order to receive a screw 70 to be driven by means of the tool bit 60. Thus, missing of the screw 70 is avoided in operation.

Figure 8:
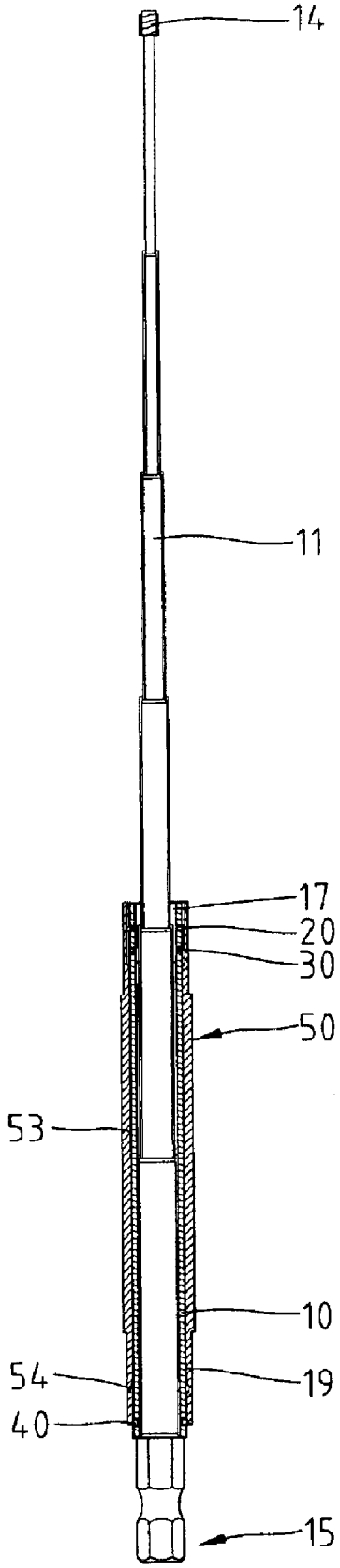
FIG. 8 is a cross-sectional view of the extension apparatus of FIG. 8.
Figure 9:
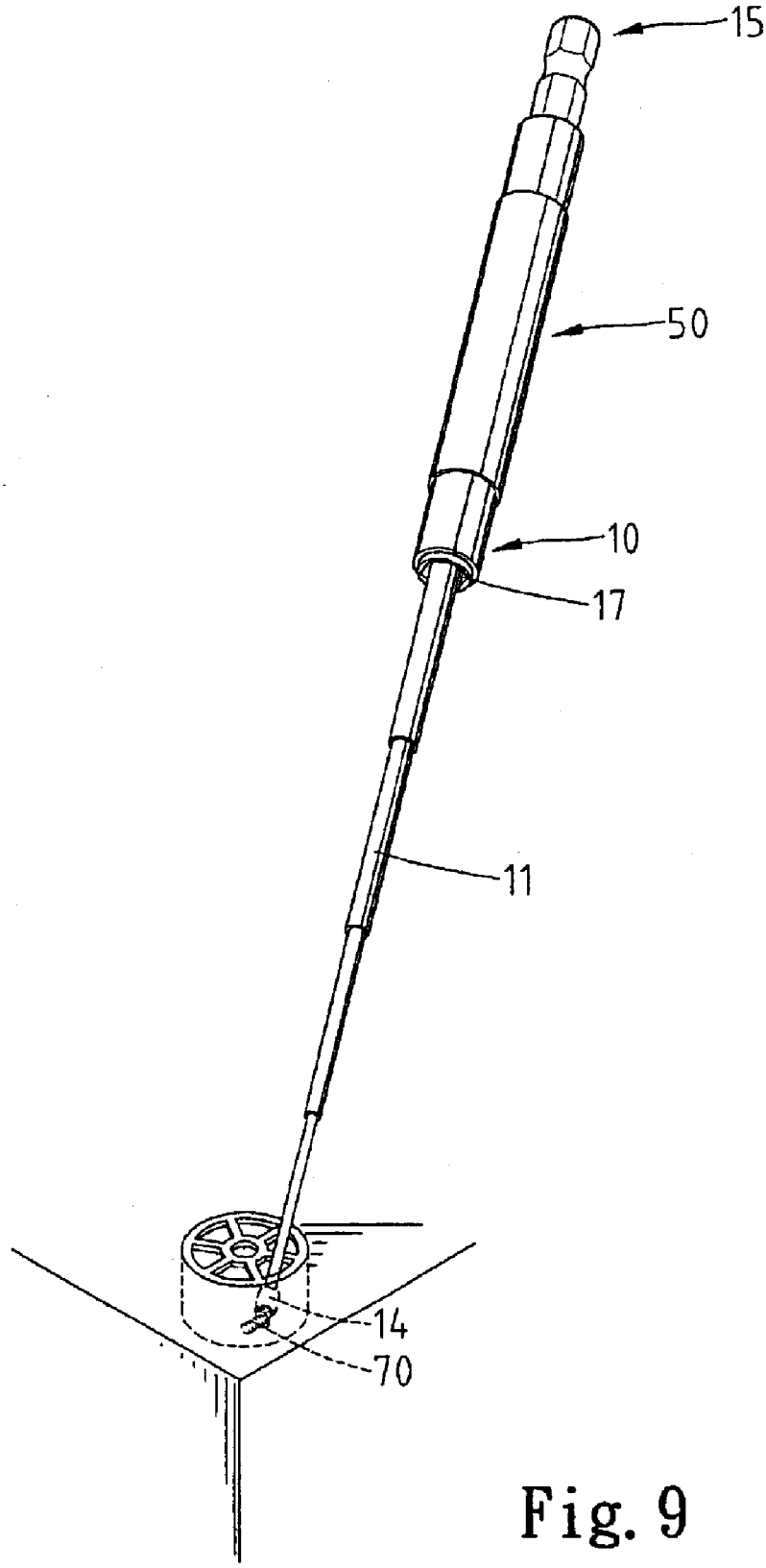
FIG. 9 is a perspective view showing the extension apparatus of FIG. 9 in use.

Referring to FIGS. 8 and 9, the telescopic element 11 is extended from the socket 19 and the barrel 50 so that the magnet 14 can attract a screw 70 missing in a limited space.

Figure 10:
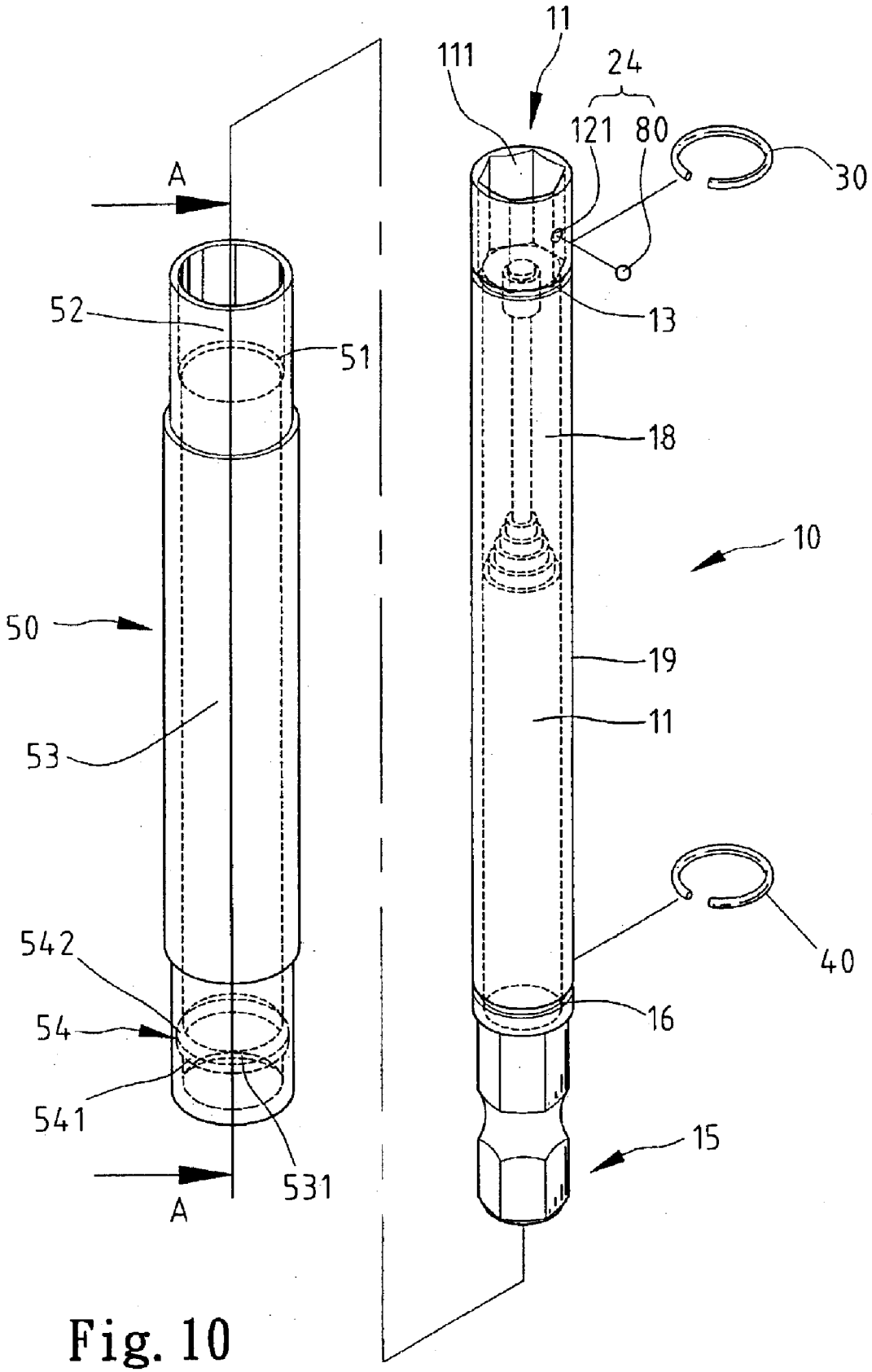
FIG. 10 is an exploded view of an extension apparatus according to a second embodiment of the present invention.

FIG. 10 shows an extension apparatus according to a second embodiment of the present invention. The second embodiment is similar to the first embodiment except for a retention device 24 including a ball 80 received in aperture 121 instead of the boss 22 of the first ring 20. Accordingly, in the second embodiment, the necessity of the first annular groove 12 is eliminated. The ball 80 is inserted through the aperture 121 into a hexangular space 111 for receiving a tool bit 60.

The present invention has been described through detailed illustration of two embodiments. Those skilled in the art can derive variations from the embodiments without departing from the scope of the present invention. Therefore, the embodiments shall not limit the scope of the present invention defined in the claims.

What is claimed is:

1. An extension apparatus for connecting a tool with a tool bit, the extension apparatus including a driving element with a first end for engagement with the tool and a second end for engagement with the tool bit; a telescopic element inserted in the driving element; a magnet attached to the telescopic element; a barrel movably mounted on the driving element for receiving a fastener to be driven by the tool bit, with the barrel having a first end and a second end, with an annular stop groove defined in an external side of the driving element adjacent the second end of the driving element; and a stop ring located in the annular stop groove of the driving element, with an annular stop groove defined in an internal side of the barrel between the first and second ends, with the annular stop groove of the barrel including an annular shoulder and an annular slope, with the annular shoulder located intermediate the annular slope and the first end of the barrel, with the annular shoulder abutting with the stop ring for keeping the barrel on the driving element, the annular slope having increasing spacing from the internal side in a direction toward the first end of the barrel facilitating removal of the stop ring from the annular stop groove formed in the barrel when moving the barrel toward the first end of the driving element.

2. The extension apparatus according to claim 1 wherein the driving element includes an insert formed at the first end and a socket formed at the second end.

3. The extension apparatus according to claim 2 including a detent, wherein the socket defines a space for receiving the tool bit and an aperture communicated with the space, and the detent is extensible into the space defined in the socket for contact with the tool bit.

4. The extension apparatus according to claim 3 including an elastic element for biasing the detent.

5. The extension apparatus according to claim 4 wherein the elastic element is a detent ring mounted on the socket.

6. The extension apparatus according to claim 5 wherein the detent ring is a C-ring.

7. The extension apparatus according to claim 5 wherein the socket defines an annular detent groove defined in an external side in order to receive the detent ring.

8. The extension apparatus according to claim 5 wherein the detent is a boss integrally extending from and formed as a single piece with the detent ring.

9. The extension apparatus according to claim 3 wherein the detent is a ball.

10. The extension apparatus according to claim 1 further comprising: an end ring, with an annular end groove formed in the driving element adjacent the first end of the driving element, with the end ring located in the annular end groove; and an annular slope defined in the internal side of the barrel at the first end of the barrel for abutting the end ring, with the annular slope at the first end of the barrel having decreasing spacing from the internal side in a direction toward the second end of the barrel.

11. The extension apparatus according to claim 10 wherein the driving element includes an insert formed at the first end and a socket formed at the second end.

12. The extension apparatus according to claim 11 including a detent, wherein the socket defines a space for receiving the tool bit and an aperture communicated with the space, and the detent is extensible into the space defined in the socket for contact with the tool bit.

13. The extension apparatus according to claim 12 including an elastic element for biasing the detent.

14. The extension apparatus according to claim 13 wherein the elastic element is a detent ring mounted on the socket.

15. The extension apparatus according to claim 14 wherein the detent ring is a C-ring.

16. The extension apparatus according to claim 14 wherein the socket defines an annular detent groove defined in an external side in order to receive the detent ring.

17. The extension apparatus according to claim 14 wherein the detent is a boss integrally extending from and formed as a single piece with the detent ring.

18. The extension apparatus according to claim 12 wherein the detent is a ball.

19. The extension ring according to claim 10 when the end ring is a C-ring.

20. The extension ring according to claim 1 wherein the stop ring is a C-ring.

* * * * *